US008485115B2

(12) United States Patent
Spade et al.

(10) Patent No.: US 8,485,115 B2
(45) Date of Patent: Jul. 16, 2013

(54) WATERCRAFT WITH BOW SPONSONS

(75) Inventors: Sam Spade, Palm Bay, FL (US); Lonnie Lieb, West Melbourne, FL (US); Rick Adamczyk, St-Cloud, FL (US)

(73) Assignee: Bombardier Recreational Products Inc., Valcourt (CA)

( * ) Notice: Subject to any disclaimer, the term of this patent is extended or adjusted under 35 U.S.C. 154(b) by 127 days.

(21) Appl. No.: 12/894,317

(22) Filed: Sep. 30, 2010

(65) Prior Publication Data

US 2012/0079976 A1 Apr. 5, 2012

(51) Int. Cl.
*B63B 35/73* (2006.01)
*B63B 1/22* (2006.01)

(52) U.S. Cl.
USPC ..... 114/55.54; 114/284

(58) Field of Classification Search
USPC ..... 114/123, 55.54, 55.55, 284
See application file for complete search history.

(56) References Cited

U.S. PATENT DOCUMENTS

| | | | | |
|---|---|---|---|---|
| 2,752,874 | A | 7/1956 | Held | |
| 3,934,531 | A | 1/1976 | Allen | |
| 4,060,865 | A | 12/1977 | Woolworth | |
| 4,287,624 | A | 9/1981 | Lowther | |
| 4,627,373 | A | 12/1986 | Nishida | |
| 4,970,980 | A | 11/1990 | Eisner | |
| 5,050,517 | A | 9/1991 | Kobayashi | |
| 5,515,802 | A * | 5/1996 | Bree | 114/123 |
| 5,685,254 | A | 11/1997 | Jacques | |
| 5,819,678 | A | 10/1998 | Austin | |
| 5,870,965 | A | 2/1999 | Hansen | |
| 6,032,605 | A * | 3/2000 | Takashima | 114/284 |
| 6,210,242 | B1 | 4/2001 | Howard et al. | |
| 6,619,224 | B1 * | 9/2003 | Syfritt | 114/352 |
| 6,651,579 | B1 | 11/2003 | Wynne et al. | |
| 6,712,016 | B1 | 3/2004 | Morisch et al. | |
| 6,776,114 | B2 | 8/2004 | Abe | |
| 6,807,920 | B1 * | 10/2004 | Wynne | 114/284 |
| 6,883,455 | B2 | 4/2005 | Maeda et al. | |
| 7,182,033 | B1 * | 2/2007 | Phillips et al. | 114/248 |
| 7,707,959 | B2 | 5/2010 | Miura et al. | |
| 7,775,172 | B2 | 8/2010 | Hansen | |
| 2004/0129192 | A1 | 7/2004 | Guerard | |
| 2009/0120342 | A1 | 5/2009 | Chiu | |
| 2009/0223431 | A1 | 9/2009 | Loui et al. | |

FOREIGN PATENT DOCUMENTS

| | | | |
|---|---|---|---|
| GB | 2363762 | A | 1/2002 |
| JP | 2003137188 | A | 5/2003 |

OTHER PUBLICATIONS

English Abstract of JP2003137188; Published May 14, 2003.
Kaiapoi ITM 2010 New Zeland Jetboat Marathon—Final Day, Power Boat World [online], [retrieved on Oct. 19, 2010]. Retrieved from the Internet: <URL: http://www.powerboat-world.com/index.cfm?nid=75924&rid=13&sc=arc>.
World Jet Boat Marathon Media Release, Boatracingfacts [online], Jul. 9, 2007, [retrieved on Oct. 19, 2010]. Retrieved from the Internet: <URL: http://boatracingfacts.com/forums/showthread.php?t=4731>.

* cited by examiner

*Primary Examiner* — Stephen Avila
(74) *Attorney, Agent, or Firm* — BCF LLP

(57) ABSTRACT

A watercraft has a hull having a bow, a deck disposed on the hull, an engine connected to the hull, a propulsion system operatively connected to the engine, a first bow sponson disposed on a starboard side of the bow, and a second bow sponson disposed on a port side of the bow. A sponson suitable for use on a bow of a watercraft is also disclosed.

16 Claims, 10 Drawing Sheets

WATERCRAFT WITH BOW SPONSONS

TECHNICAL FIELD

The present invention relates to watercraft with bow sponsons.

BACKGROUND

Current watercraft are stable and handle well. However, under certain driving conditions, although the watercraft is sufficiently stable and handles adequately, it may be desirable to nonetheless provide additional stability and improved handling.

One known solution consists in providing sponsons on either side of the watercraft near a transom thereof. The sponsons cause the transom to lift while the watercraft is in motion and assist in turning.

Under certain driving conditions, although current watercraft designs handle adequately, it may be desirable to nonetheless also provide lifting of the bow and/or some resistance to turning.

SUMMARY

A watercraft having bow sponsons is provided. The bow sponsons lift the bow of the watercraft and provide some resistance to turning under certain driving conditions.

A sponson suitable for use on a bow of a watercraft is also provided.

In one aspect, a watercraft has a hull having a bow, a deck disposed on the hull, an engine connected to the hull, a propulsion system operatively connected to the engine, a first bow sponson disposed on a starboard side of the bow, and a second bow sponson disposed on a port side of the bow.

In another aspect, a sponson has an inner member and an outer deflector. The inner member has an inner lateral surface, an outer lateral surface, and a lower surface. The inner lateral surface has a concave arcuate profile. The outer deflector has at least a portion connected to the outer lateral surface of the inner member in one of a plurality of possible positions. The outer deflector extends beyond the lower surface of the inner member.

For purposes of this application, terms related to spatial orientation such as forwardly, rearwardly, left, and right are as they would normally be understood by a driver of the watercraft sitting thereon in a normal driving position.

Also for purposes of this application, the term "sponson" refers to a structural projection from the side of the watercraft designed to increase lateral stability in the water.

Embodiments of the present invention each have at least one of the above-mentioned aspects, but do not necessarily have all of them.

Additional and/or alternative features, aspects, and advantages of embodiments of the present invention will become apparent from the following description, the accompanying drawings, and the appended claims.

BRIEF DESCRIPTION OF THE DRAWINGS

For a better understanding of the present invention, as well as other aspects and further features thereof, reference is made to the following description which is to be used in conjunction with the accompanying drawings, where.

DETAILED DESCRIPTION

A personal watercraft 10 having bow sponsons 100 will be described below. It is contemplated that the bow sponsons 100 could be used in combination with other types of watercraft such as, but not limited to, sport boats.

Figure 1:
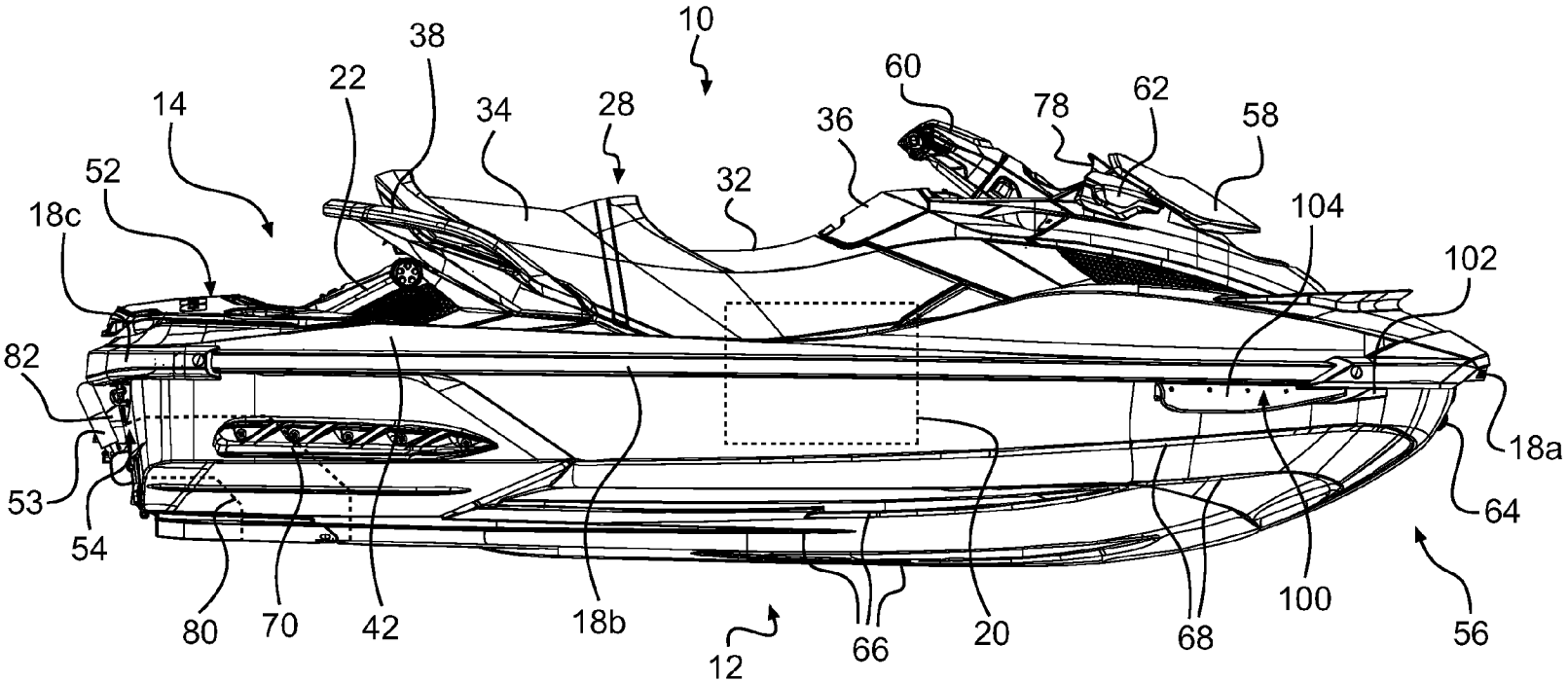
FIG. 1 is a right side elevation view of a personal watercraft.
Figure 2:
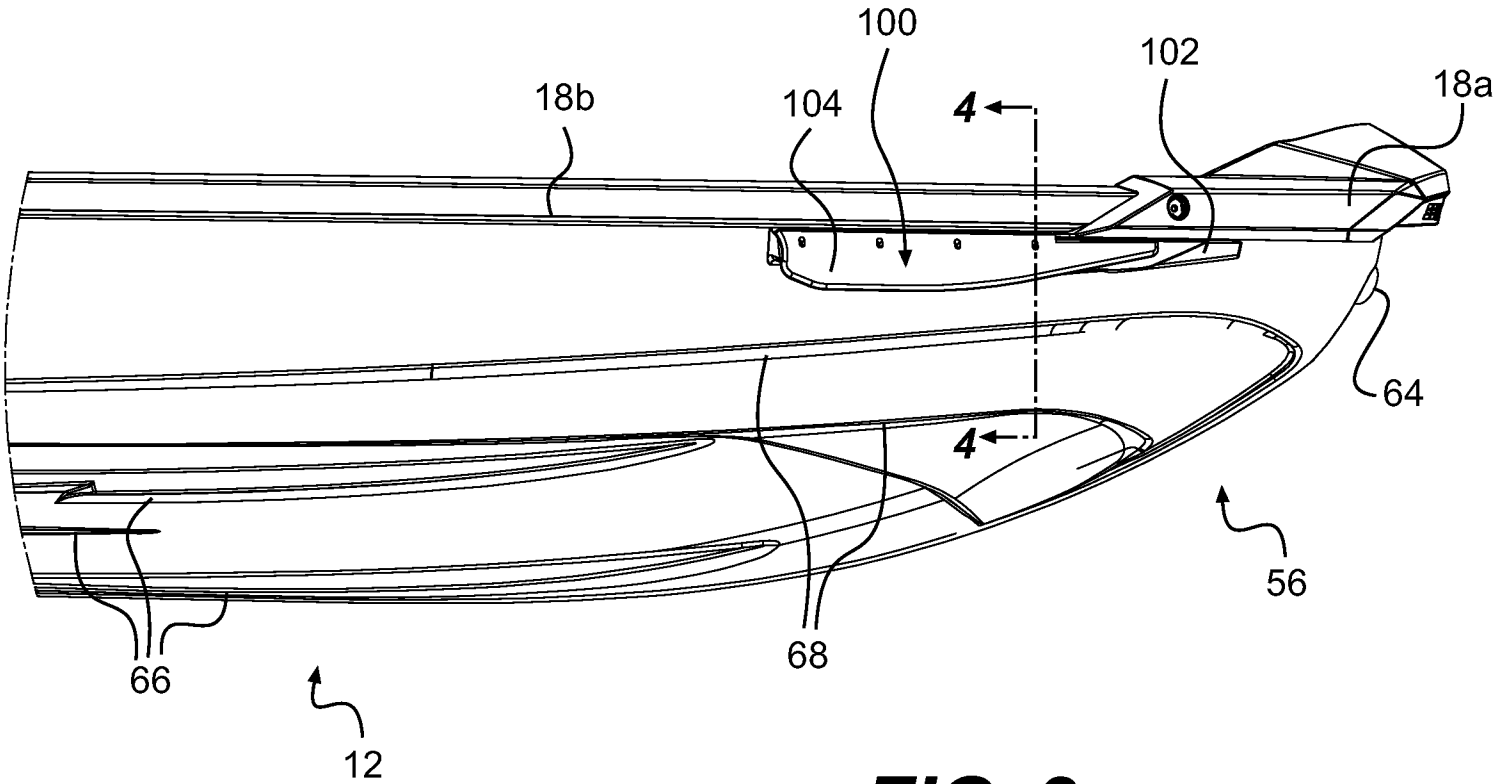
FIG. 2 is a right side elevation view of a forward portion of a hull of the watercraft of FIG. 1.

Referring to FIG. 1, the general construction of a personal watercraft 10 will be described. It should be understood that the personal watercraft 10 could have a construction other than the one described below.

The watercraft 10 is made of two main parts, including a hull 12 and a deck 14. The hull 12 buoyantly supports the watercraft 10 in the water. The deck 14 is designed to accommodate a rider and passengers. The hull 12 and deck 14 are joined together at a seam 16 (FIG. 4) that joins the parts in a sealing relationship. Preferably, the seam 16 comprises a bond line formed by an adhesive 17. Other known joining methods could be used to sealingly engage the hull 12 and deck 14 together, including but not limited to thermal fusion, molding or fasteners such as rivets or screws. Bumpers 18 generally cover the seam 16, which helps to prevent damage to the outer surface of the watercraft 10 when the watercraft 10 is docked, for example. The bumpers 18 include a bow bumper 18*a* that extends around a front portion of the bow 56, side bumpers 18*b* that extends along the port and starboard sides of the watercraft 10, and a transom bumper 18*c* that extends around the transom 54. It is contemplated that the watercraft 10 could have other bumper configurations. For example, it is contemplated that the watercraft 10 could have a single bumper 18 covering the entire seam 16.

The space between the hull 12 and the deck 14 forms a volume, inside of which the engine 20 (schematically shown in FIG. 1) is disposed, as well as a muffler, tuning pipe, gas tank, electrical system (battery, electronic control unit, etc.), air box and other elements required or desired in the watercraft 10.

The deck 14 has a centrally positioned straddle seat 28 positioned on top of a pedestal 22 to accommodate riders in a straddling position. The seat 28 is sized to accommodate three riders, but it is contemplated that the seat 28 could be designed to accommodate more or less than three riders. The seat 28 includes a first, front seat portion 32 and a rear, raised seat portion 34 that accommodates a passenger. The seat 28 is made as a cushioned or padded unit or interfitting units. The first and second seat portions 32, 34 are removably attached to the pedestal 22 by a hook and tongue assembly (not shown) at the front of each seat portion and by a latch assembly (not shown) at the rear of each seat portion, or by any other known attachment mechanism. The seat portions 32, 34 can be individually tilted or removed completely. One of the seat portions 32, 34 covers an engine access opening defined by a top portion of the pedestal 22 to provide access to the engine 20. The other seat portion (in this case portion 34) covers a removable storage box (not shown). A small storage box 36 is provided in front of the seat 28. A grab handle 38 is provided between the pedestal 22 and the rear of the seat 28 to provide a handle onto which a passenger may hold.

The watercraft 10 has a pair of generally upwardly extending walls located on either side of the watercraft 10 known as gunwales or gunnels 42. The gunnels 42 help to prevent the entry of water in the footrests (not shown) of the watercraft 10, provide lateral support for the rider's feet, and also provide buoyancy when turning the watercraft 10, since personal watercraft roll slightly when turning.

A reboarding platform 52 is provided at the rear of the watercraft 10 on the deck 14 to allow the rider or a passenger to easily reboard the watercraft 10 from the water when the watercraft 10 is at rest. Carpeting or some other suitable covering covers the reboarding platform 52. A retractable ladder 53 is affixed to the transom 54 to facilitate boarding of the watercraft 10 from the water onto the reboarding platform 52.

The watercraft 10 is provided with a hood 58 located forwardly of the seat 28 and a steering assembly including a helm assembly 60. A hinge (not shown) is attached between a forward portion of the hood 58 and the deck 14 to allow the hood 58 to move to an open position to provide access to a front storage bin (not shown). A latch (not shown) located at a rearward portion of the hood 58 locks the hood 58 into a closed position. When in the closed position, the hood 58 prevents water from entering the front storage bin. Rearview mirrors 62 are positioned on either side of hood 58 to allow the rider to see behind the watercraft 10. A hook 64 is located at the bow 56 of the watercraft 10. The hook 64 is used to attach the watercraft 10 to a dock when the watercraft 10 is not in use or to attach to a winch when loading the watercraft 10 on a trailer, for instance.

An exterior surface of the hull 12 is provided with a combination of strakes 66 and chines 68. A strake 66 is a protruding portion of the hull 12. A chine 68 is the vertex formed where two surfaces of the hull 12 meet. The combination of strakes 66 and chines 68 provide the watercraft 10 with its riding and handling characteristics.

Rear sponsons 70 are located on both sides of the hull 12 near the transom 54. The rear sponsons 70 preferably have an arcuate undersurface that gives the watercraft 10 both lift while in motion and improved turning characteristics. The rear sponsons 70 are preferably fixed to the exterior surface of the hull 12 and can be attached to the hull by fasteners as shown or molded therewith. Sometimes it may be desirable to adjust the position of the rear sponson 70 with respect to the hull 12 to change the handling characteristics of the watercraft 10 and accommodate different riding conditions. Bow sponsons 100 are located on both sides of the bow 56 of the hull 12. The position of the bow sponsons 100 and the bow sponsons 100 themselves will be described in greater detail below.

The helm assembly 60 is positioned forwardly of the seat 28. The helm assembly 60 has a central helm portion, which may be padded, and a pair of steering handles, also referred to as a handlebar. One of the steering handles is provided with a throttle operator (not shown), which allows the rider to control the engine 20, and therefore the speed of the watercraft 10. The throttle operator can be in the form of a thumb-actuated throttle lever, a finger-actuated throttle lever, or a twist grip. The throttle operator is movable between an idle position and multiple actuated positions. The throttle operator is preferably biased towards the idle position, such that when the driver of the watercraft lets go of the throttle operator, it will move to the idle position.

A display area or cluster 78 is located forwardly of the helm assembly 60. The display cluster 78 can be any display type, including, but not limited to, one or more of a liquid crystal display (LCD), dials or LED (light emitting diodes). The central helm portion has various buttons (not shown), which could alternatively be in the form of levers or switches, that allow the driver to modify the display data or mode (speed, engine rpm, time . . . ) on the display cluster 78. Buttons (not shown) may also used by the driver to control a water jet propulsion system 80 of the watercraft 10.

The watercraft 10 is propelled by a water jet propulsion system 80 (schematically shown in FIG. 1) including a jet pump (not shown) powered by the engine 20. It is contemplated that other types of propulsion system, such as propellers, could be used. The water jet propulsion system 80 pressurizes water and accelerates it to create thrust. The water is first scooped from under the hull 12 through an inlet grate. The inlet grate prevents large rocks, weeds, and other debris from entering the water jet propulsion system. Water then flows through the water intake ramp. From the intake ramp, water then enters the jet pump. The jet pump is made of two main parts: the impeller and the stator. The impeller is coupled to the engine 20 by one or more shafts, such as a driveshaft and an impeller shaft. The rotation of the impeller pressurizes the water, which then moves over the stator that is made of a plurality of fixed stator blades. The role of the stator blades is to decrease the rotational motion of the water so that almost all the energy given to the water is used for thrust, as opposed to swirling the water. Once the water leaves the jet pump, it goes through the venturi. Since the venturi's exit diameter is smaller than its entrance diameter, the water is accelerated further, thereby providing more thrust. A steering nozzle is pivotally attached to the venturi through a vertical pivot point. The steering nozzle is operatively connected to the helm assembly 60 via a push-pull cable (not shown) such that when the handlebar helm assembly 60 is turned, the steering nozzle pivots, redirects the water coming from the venturi, so as to steer the watercraft in the desired direction. The watercraft 10 is also provided with a reverse gate 82.

The reverse gate 82 can be lowered behind the steering nozzle so as to redirect water coming from the steering nozzle towards a front of the watercraft 10, thereby causing the watercraft to move in a reverse direction.

Turning now to FIGS. 4 to 8, the starboard bow sponson 100 will be described. Although not described herein in detail, it should be understood that the port bow sponson 100 is a mirror image of the starboard bow sponson 100.

Figure 8:
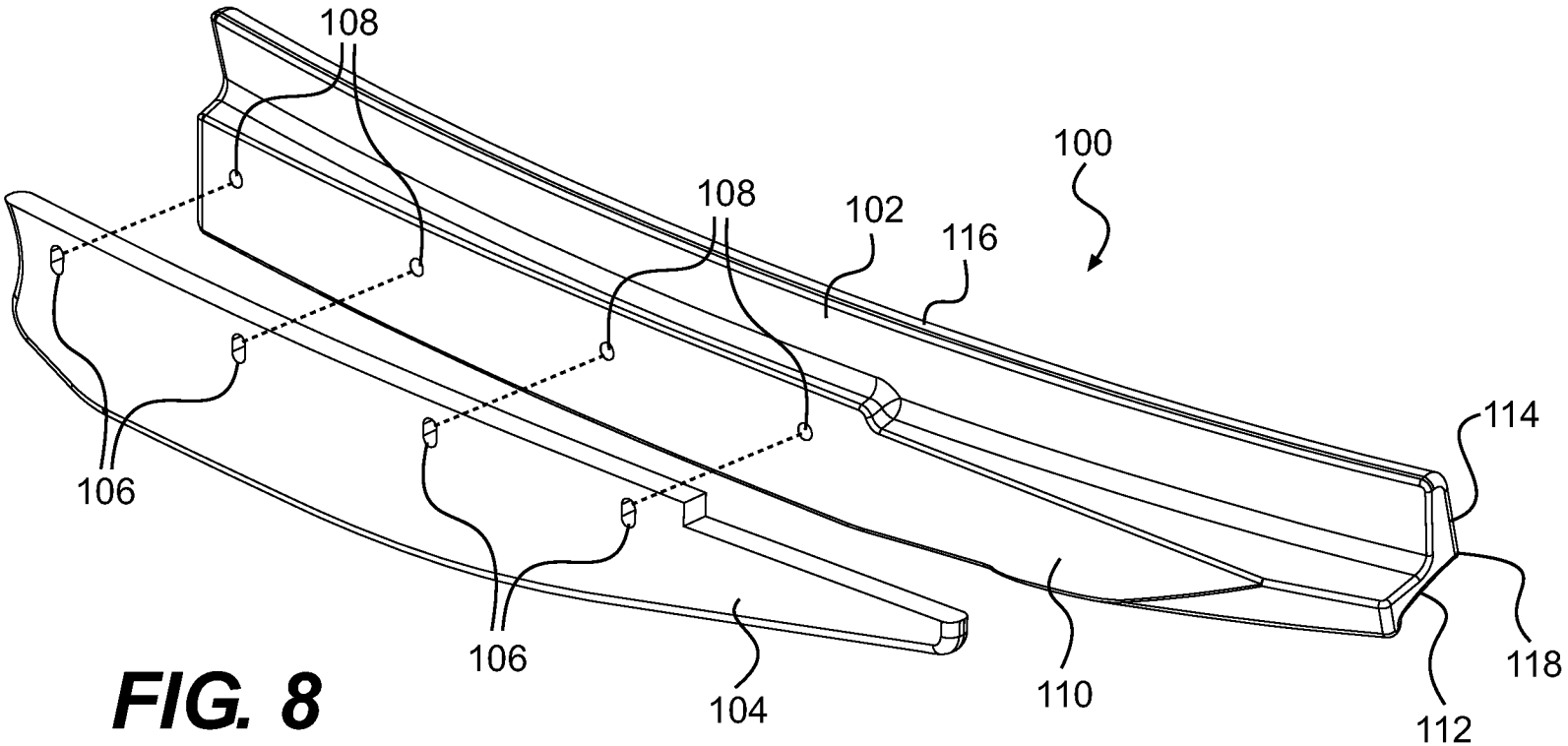
FIG. 8 is a perspective exploded view of the sponson of FIG. 5.

As best seen in FIG. 8, the bow sponson 100 is made of two main parts: an inner member 102 and an outer deflector 104. The outer deflector 104 has four oblong apertures 106 formed therein. Fasteners (not shown), such as screws or bolts, are inserted through the apertures 106 and are received in four corresponding threaded apertures 108 formed in the outer lateral surface 110 of the inner member 102, thus fastening the outer deflector 104 to the inner member. Since the apertures 106 are oblong, the outer deflector 104 can be fastened to the inner member 102 in a plurality of positions. In the present embodiment, each aperture 106 provides for approximately 5 mm of adjustment, but it is contemplated that the apertures 106 could allow for more or less adjustment and that the apertures 106 could each provide different amounts of adjustment. It is contemplated that each oblong aperture 106 could be replaced by a plurality of apertures, thereby providing different attachment points to provide the plurality of positions. It is also contemplated that the apertures 106 could be shaped so as to permit adjustment of a pitch of the outer deflector 104 relative to the inner member 102. Alternatively or additionally, it is contemplated that a plurality of apertures 108 could be provided in the inner member for each aperture 106 thereby providing different attachment points to provide the plurality of positions. It is contemplated that more or less than four apertures 106, 108 could be provided. It is also contemplated that the outer deflector 104 could be connected to the inner member 102 by other means, such as an adhesive for example. It is also contemplated that the inner member 102 could be integrally formed with the outer deflector 104.

Figure 4:
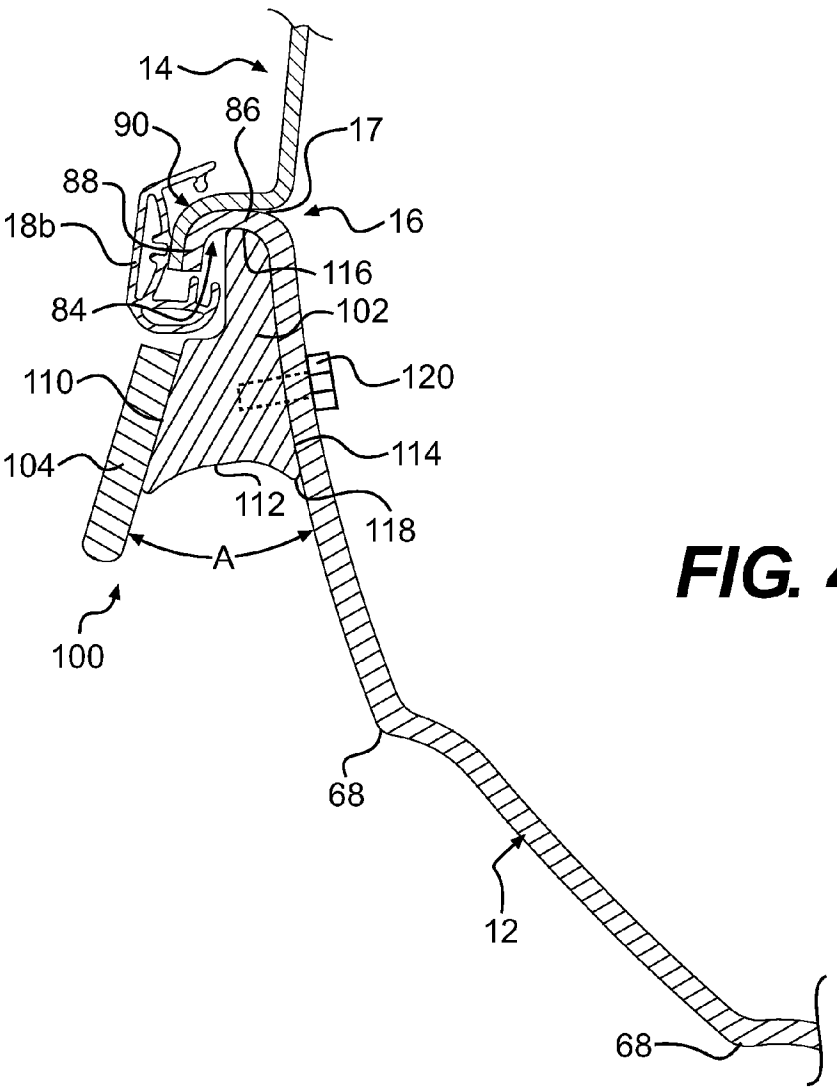
FIG. 4 is a cross-sectional view of the hull and a starboard bow sponson of the watercraft of FIG. 1 taken through line 4-4 of FIG. 2.
Figure 5:
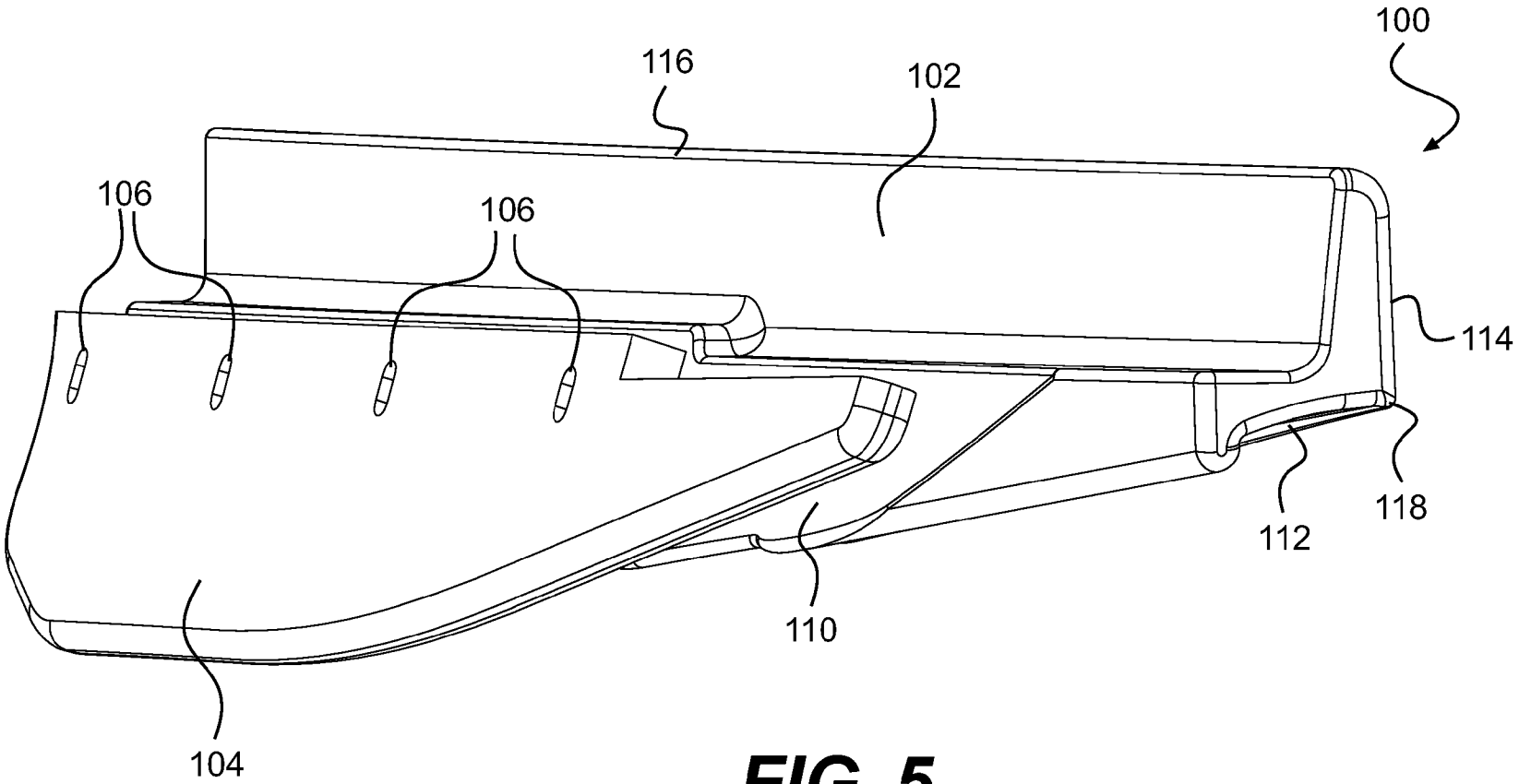
FIG. 5 is a front elevation view of the starboard bow sponson of the watercraft of FIG. 1.
Figure 7:
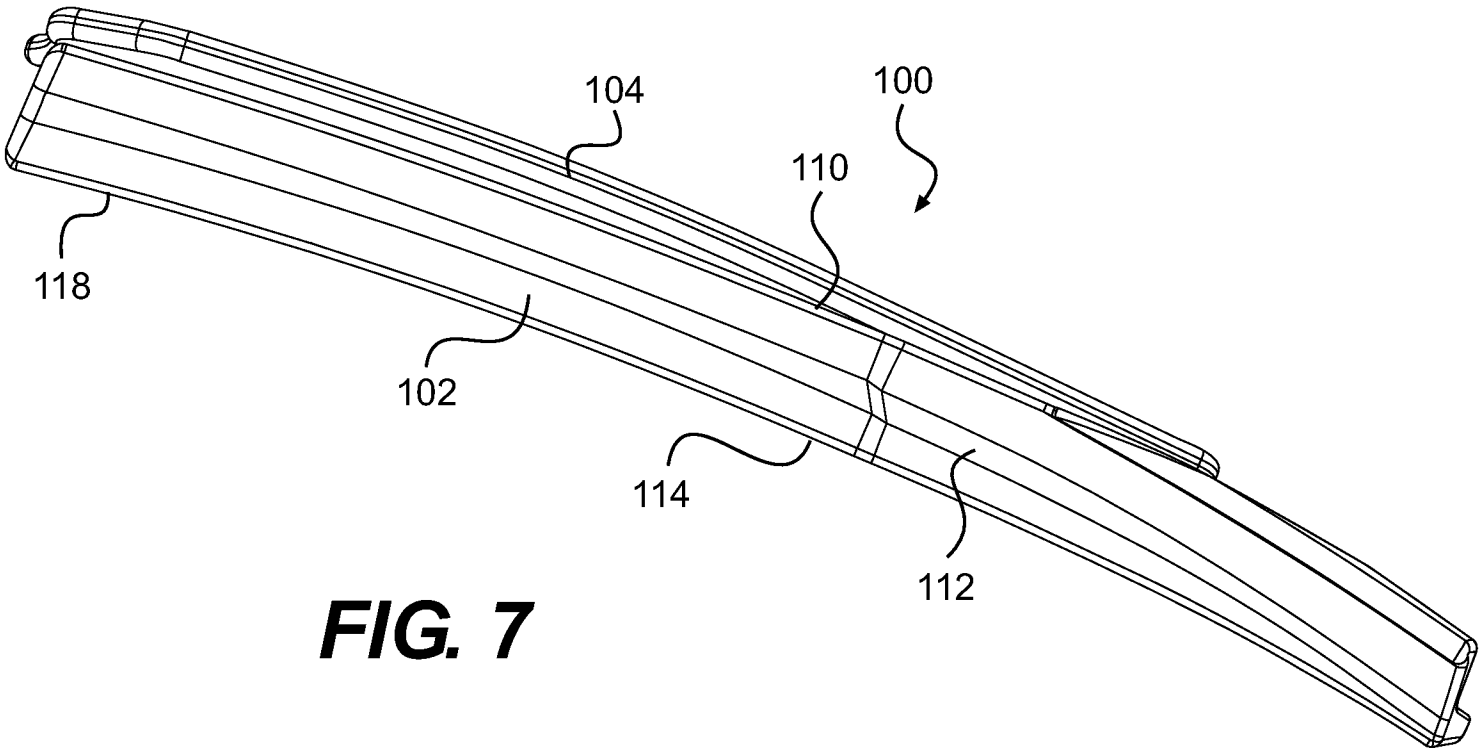
FIG. 7 is bottom plan view of the bow sponson of FIG. 5.

As seen in FIGS. 4, 5 and 8, the inner member 102 has a generally L-shaped lateral cross-section. It is contemplated that the inner member could have other cross-sectional shapes, such as, but not limited to, triangular. As can also be seen in FIG. 4, the inner member 102 has a concave lower surface 112. It is contemplated that the lower surface 112 could be flat and oriented horizontally or at an angle. As best seen in FIG. 7, an inner lateral surface 114 of the inner member 102 has a longitudinal concave arcuate profile so as to be complementary in shape to the convex curvature of the bow 56 at the location where the bow sponson 100 is to be mounted. It should be understood that should the location of the bow 56 where the bow sponson 100 is to be mounted have a profile other than convex, then the inner lateral surface 114 would have a profile of a shape which is complementary to this profile so as to abut this location of the bow 56. It is also contemplated that the inner member 102 could be at least slightly flexible so as to deform to adopt the shape of the bow 56 at the location where the bow sponson 100 is to be mounted when the bow sponson 100 is connected to the bow 56.

Figure 6:
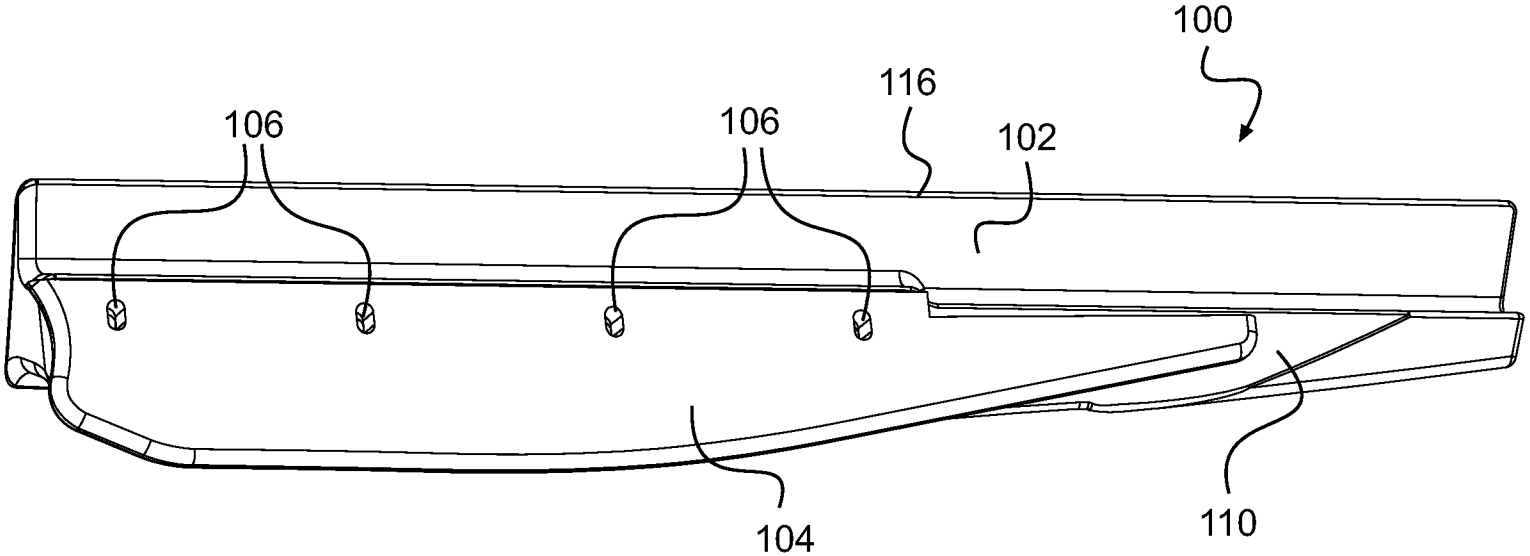
FIG. 6 is a right side elevation view of the bow sponson of FIG. 5.

The outer deflector 104 has an inner lateral side having a profile that is complementary in shape to the profile of the portion of the outer lateral surface 110 of the inner member 102 to which the outer deflector 104 is connected. As can be seen in FIGS. 4 to 6, when it is connected to the inner member 102, the outer deflector 104 extends vertically below the inner member 102. As best seen in FIG. 5, the outer deflector 104 tapers towards a front thereof such that a rear portion of the outer deflector 104 extends vertically below the inner member 102 by a greater distance than a forward portion of the outer deflector 104. The outer deflector 104 in the present embodiment is shorter than the inner member 102. However, it is contemplated that the outer deflector 104 could have other lengths.

Figure 9:
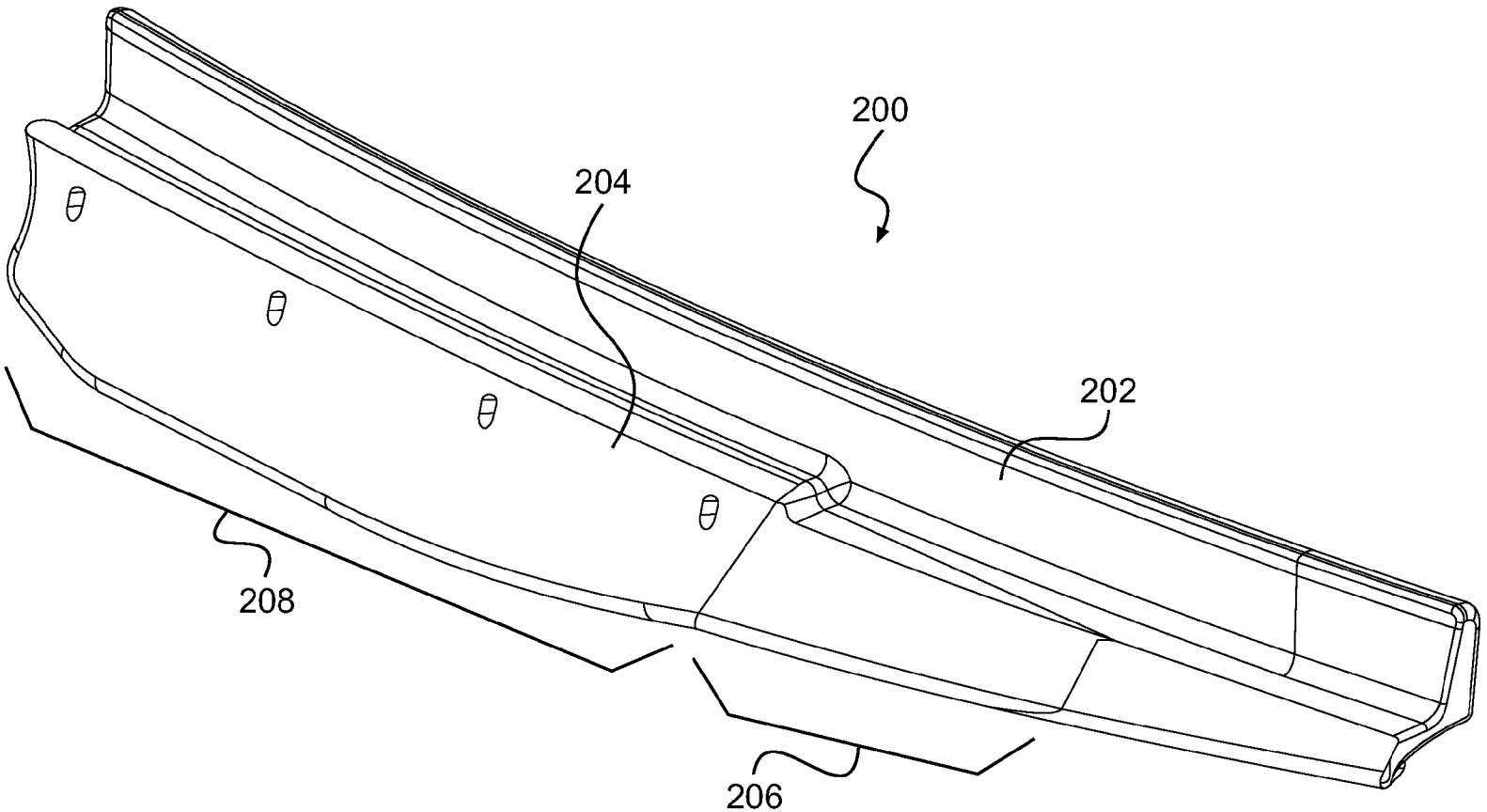
FIG. 9 is a perspective view of an alternative embodiment of a starboard bow sponson.

Turning now to FIG. 9, a bow sponson 200, which is an alternative embodiment of the bow sponson 100, will be described. The bow sponson 200 is made of an inner member 202 and an outer deflector 204. The outer deflector 204 is made of two portions. A forward portion 206 of the outer deflector 204 is integrally formed with the inner member 202. A remaining portion 208 of the outer deflector 204 is fastened to the inner member 202 in a manner similar to the one used to fasten the outer deflector 104 to the inner member 102 of the bow sponson 100 described above. As such, the portion 208 of the outer deflector 204 can be fastened in a plurality of positions. The remaining features of the bow sponson 200 are similar to those of the bow sponson 100 described above.

Figure 10:
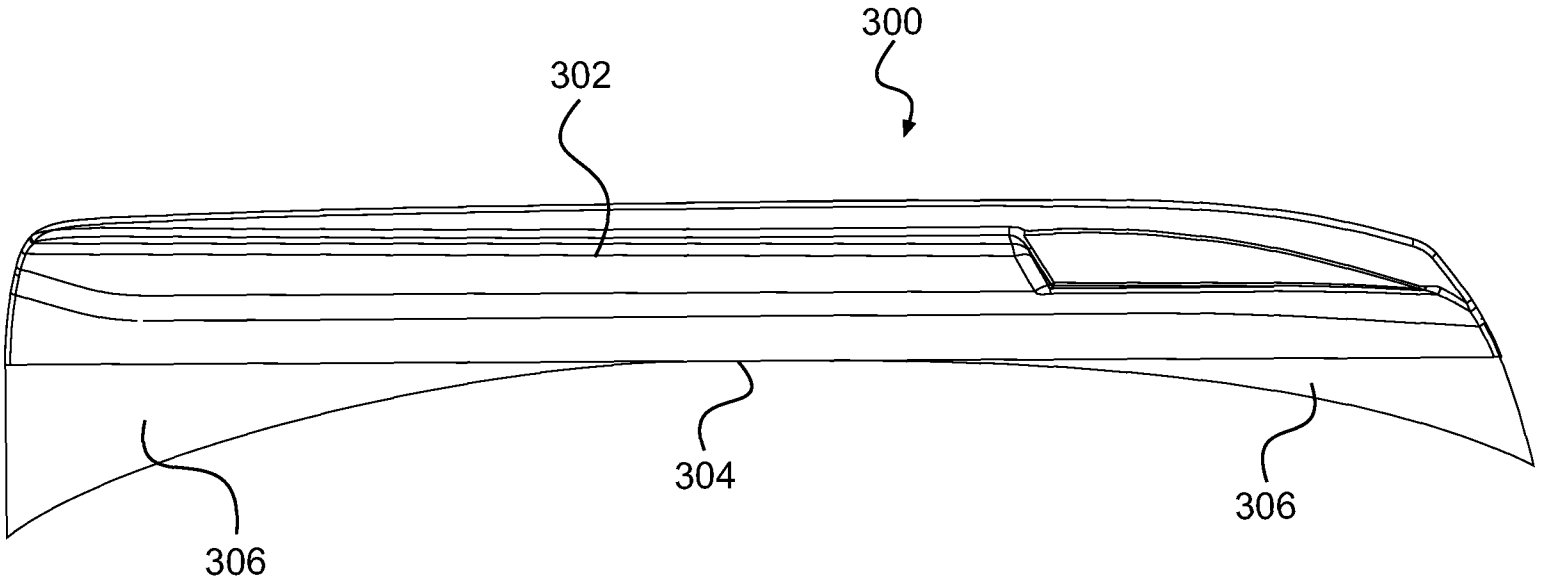
FIG. 10 is a bottom plan view of another alternative embodiment of a starboard bow sponson.

Turning now to FIG. 10, a bow sponson 300, which is an alternative embodiment of the bow sponson 100, will be described. The bow sponson 300 has a unitary sponson body 302 having a concave lower surface. It is contemplated that the sponson body 302 could also be made in two parts (i.e. inner member and outer deflector) like the bow sponsons 100 and 200 described above. Unlike the inner member 102 of the bow sponson 100 which has an arcuate inner surface 114, the sponson body 302 has a straight inner lateral surface 304. In order to have the bow sponson 300 conform to the shape of the location on the bow 56 where it is to be disposed, the bow sponson 300 has two adapters 306 connected to the inner lateral surface 304 of the sponson body 302. The adapters 306 are bonded to the sponson body 302. However, it is contemplated that the adapters 306 could be fastened to the sponson body 302. It is also contemplated that only one or more than two adapters 306 could be used. As can be seen, the adapters 306 form an inner arcuate profile shaped so as to be complementary to the shape of the bow 56 at the location where the bow sponson 300 is to be disposed. In one embodiment, the adapters 306 are made of a resilient material such as rubber. By using this type of material, even if the shape of the adapters 306 does not correspond exactly to the shape of the bow 56 prior to fastening the bow sponson 300 to the bow, when the bow sponson 300 is fastened to the bow 56, the resilient material gets compressed between the sponson body 302 and the bow 56 and the shape of the adapter 306 then conforms to the shape of the bow 56.

Turning now to FIGS. 1 to 4, the position of the bow sponsons 100 on the watercraft 10 will be described. The bow sponsons 200 and 300 would be similarly positioned, and therefore will not be described herein.

Figure 3:
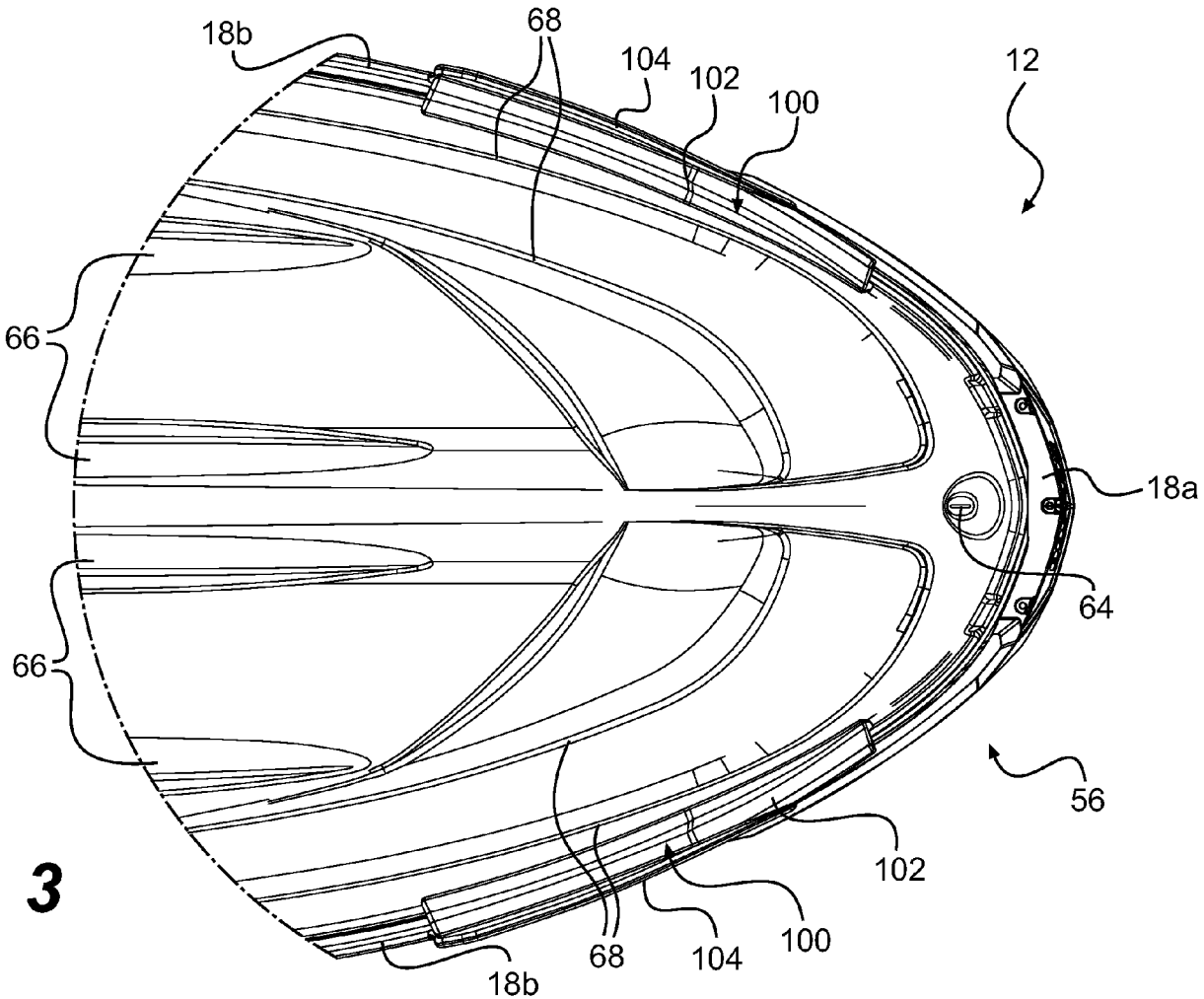
FIG. 3 is a bottom plan view of the forward portion of the hull of the watercraft of FIG. 1.

As can be seen in FIG. 3, the bow sponsons 100 are disposed on either side of the bow 56 on the portion of the hull 12 converging toward a longitudinal centerline of the watercraft 10 formed by the bow 56. In the present embodiment, the bow 56 corresponds to the forward portion of the hull 12 and has a length of approximately a third of a length of the hull 12. It should be understood that other types of watercraft may have longer or shorter bows.

The fronts of the bow sponsons 100 are space from the front end of the hull 12. As seen in FIG. 1, the rears of the bow sponsons 100 are disposed forwardly of a front end of the straddle seat 28 and forwardly of the helm assembly 60. As a result, the rears of the bow sponsons 100 are disposed forwardly of and are spaced from the fronts of the rear sponsons 70. It is contemplated that the bow sponsons 100 could be positioned closer to the front end of the hull 12 than illustrated, however the fronts of the bow sponsons 100 should remain laterally spaced apart from each other to allow water to flow between the bow sponsons 100 onto the bow 56 prior to flowing under the bow sponsons 100. It is also contemplated that the bow sponsons 100 could be positioned further from the front end of the hull 12 than illustrated, however the rears of the bow sponsons 100 should be position forwardly of the longitudinal midpoint of the hull 12. It is also contemplated that the bow sponsons 100 could be longer or shorter than illustrated.

As can be seen in FIG. 1, the bow sponsons 100 are disposed vertically higher on the hull 12 than the rear sponsons 70. More specifically, the lower surfaces 112 of the inner members 102 of the bow sponsons 100 are disposed vertically higher on the hull 12 than lower surfaces of the rear sponsons 70. Under most driving conditions, the bow sponsons 100 are not in contact with the body of water in which the watercraft 10 operates and therefore have no effect on the stability and/or handling of the watercraft 10. However, under certain conditions, water may rise to the level of one or both bow sponsons 100, due to a wave for example. Alternatively, the bow 56 or only a side thereof may lower in the body of water, in response to certain levels of deceleration or turning of the watercraft 10 for example. Under such conditions, one or both bow sponsons 100, depending on the particular condition, come into contact with water. As can be seen in FIG. 4, when the starboard bow sponson 100 is mounted to the hull 12, the inner member 102 is disposed between the outer deflector 104 and the bow 56. As a result, a channel is formed by the outer deflector 104, the lower surface 112 of the inner member 102 and the bow 56. In the present embodiment, the bow 56 and the outer deflector 104 form an angle A of 28 degrees therebetween. It is contemplated that the angle A could be any other angle less than 65 degrees depending on the desired characteristics. It is also contemplated that the outer deflector 104 and the bow could be generally parallel to each other. Water flowing toward the bow sponson 100 enters the channel formed thereby and flows rearwardly relative to the watercraft 10 (when the watercraft 10 is moving forwardly). This helps to stabilize yaw motion of the watercraft 10. Also, the lower surface 112 of the inner member 102 slopes downwardly from a front of the inner member 102 to a rear of the inner member 102, such that the front of the lower surface 112 is disposed vertically higher than the rear of the lower surface 112. Due to this sloping of the lower surface 112, water is deflected downwardly which results in lifting of the bow 56. The same description applies to the port bow sponson 100. The bow sponsons 100 also increase the buoyancy of the bow 56.

Turning now to FIG. 4, additional details regarding the positioning and installation of the starboard bow sponson 100 will be provided. It should be understood that the port bow sponson 100 is positioned and installed in the same manner on the port side of the watercraft 10, and as such will not be described.

As can be seen in FIG. 4, the hull 12 has a lip 84 extending laterally outwardly from an upper edge of the hull 12. The lip 84 has a generally horizontal portion 86 and a downwardly extending portion 88. The deck 14 also has a lip 90 disposed over the lip 84 to form the seam 16. The bow sponson 100 is disposed on the bow 56 such that the upper edge 116 of its inner member 102 is located vertically just below the upper edge of the hull 12 in abutment with a lower surface of the generally horizontal portion 86 of the lip 84. It is contemplated that the upper edge 116 of the inner member 102 could be disposed lower on the bow 56 so as to be spaced from the lower surface of the generally horizontal portion 86 of the lip 84. The upper edge of the inner member 102 is also disposed laterally between the downwardly extending portion 88 of the lip 84 and the outer surface of the bow 56.

The inner lateral surface 114 abuts the bow 56. In the present embodiment, the entire inner lateral surface 114 abuts the bow 56. However, it is contemplated that only the lower edge 118 of the lateral surface could abut the bow 56. By having the upper edge 116 abut the lower surface of the lip 84 and the lower edge 118 abut the bow 56, water is prevented from coming between the inner lateral surface 114 and the bow 56. It is contemplated that a seal could be provided between the inner lateral surface 114 of the inner member 102 and the bow.

To connect the bow sponson 100 to the bow 56, a plurality of fasteners 120 (only one of which is shown) are fastened into the bow 56 and the inner member 102 of the bow sponson 100. As can be seen in FIG. 4, the fasteners 120 are inserted from inside the hull 12. It is contemplated that the fasteners 120 could also extend through the apertures 108 of the inner member 102 and the apertures 106 of the outer deflector 104, thereby also fastening the outer deflector 104 to the inner member 102. It is contemplated that the bow sponson 100 could be connected to the bow 56 by other means, such as by bonding the inner lateral surface 114 of the inner member 102 to the bow 56 or by integrally forming the inner member 102 with the hull 12. It is also contemplated that the entire bow sponson (i.e. inner member 102 and outer deflector 104), could be integrally formed with the hull 12.

Modifications and improvements to the above-described embodiments of the present invention may become apparent to those skilled in the art. The foregoing description is intended to be exemplary rather than limiting. The scope of the present invention is therefore intended to be limited solely by the scope of the appended claims.

What is claimed is:

1. A watercraft comprising:
a hull having a bow;
a deck disposed on the hull;
a straddle seat disposed on the deck;
an engine connected to the hull;
a propulsion system operatively connected to the engine;
a first bow sponson disposed on a starboard side of the bow, a rear of the first bow sponson being disposed forwardly of a front of the straddle seat; and
a second bow sponson disposed on a port side of the bow, a rear of the second bow sponson being disposed forwardly of the front of the straddle seat, the first and second bow sponsons being disposed externally of the hull;
each of the first and second bow sponsons including:
an inner member and an outer deflector connected to the inner member such that the inner member is disposed laterally between the bow and the outer deflector,
the outer deflector extending vertically below the inner member such that a channel is formed by the outer deflector, a lower surface of the inner member and the bow,
a forward portion of the outer deflector extending a first distance vertically below the inner member, a rear portion of the outer deflector extending a second distance vertically below the inner member, and the second distance being greater than the first distance.

2. The watercraft of claim 1, wherein the first and second bow sponsons are disposed on a portion of the hull converging toward a longitudinal centerline of the watercraft.

3. The watercraft of claim 1, wherein a front of the first bow sponson is spaced from a front end of the hull; and
wherein a front of the second bow sponson is spaced from the front end of the hull.

4. The watercraft of claim 3, wherein the front of the first bow sponson is laterally spaced from the front of the second bow sponson.

5. The watercraft of claim 1, further comprising:
a first rear sponson disposed on a starboard side of the hull rearwardly of the first bow sponson; and
a second rear sponson disposed on a port side of the hull rearwardly of the second bow sponson.

6. The watercraft of claim 1, wherein the first and second bow sponsons are disposed vertically below an upper edge of the hull.

7. The watercraft of claim 6, wherein the hull has a lip extending laterally outwardly from the upper edge of the hull;
wherein an upper end of the first bow sponson abuts a lower surface of the lip; and
wherein an upper end of the second bow sponson abuts the lower surface of the lip.

8. The watercraft of claim 7, wherein each of the first and second bow sponsons has an inner surface facing the bow; and
wherein lower ends of the inner surfaces of the first and second bow sponsons abut the bow along their entire lengths.

9. The watercraft of claim 1, wherein each of the first and second bow sponsons has an inner surface facing the bow; and wherein inner surfaces of the first and second bow sponsons abut the bow.

10. The watercraft of claim 9, wherein the inner surfaces are arcuate inner surfaces;

wherein the arcuate inner surfaces are complementary in shape to curvatures of the bow at locations where the bow sponsons are disposed.

11. The watercraft of claim 1, wherein a lateral cross-section of each of the first and second bow sponsons has a concave lower surface.

12. The watercraft of claim 1, wherein for each of the first and second bow sponsons, at least a portion of the outer deflector is fastened to the inner member.

13. The watercraft of claim 12, wherein for each of the first and second bow sponsons, at least the portion of the outer deflector can be fastened to the inner member in a plurality of positions.

14. A sponson comprising:

an inner member having an inner lateral surface, an outer lateral surface, and a lower surface, the inner lateral surface having a concave arcuate profile, the concave arcuate profile being adapted to be complementary in shape to a curvature of a bow of a watercraft at a location where the sponson is to be disposed on the bow; and an outer deflector having at least a portion connected to the outer lateral surface of the inner member, a first portion of the outer deflector extending a first distance beyond the lower surface of the inner member, a second portion of the outer deflector extending a second distance beyond the lower surface of the inner member, the second distance being greater than the first distance, the second portion being closer to a rear of the outer deflector than the first portion, the first and second portions of the outer deflector and the lower surface of the inner member being adapted to form a channel together with the bow when the sponson is disposed on the bow.

15. The sponson of claim 14, wherein the lower surface has a concave lateral cross-section.

16. The sponson of claim 14, wherein the concave arcuate profile of the inner lateral surface is a longitudinal concave arcuate profile.

* * * * *